US006863036B2

(12) United States Patent
Kato

(10) Patent No.: US 6,863,036 B2
(45) Date of Patent: Mar. 8, 2005

(54) LUBRICATION SYSTEM FOR TWO-CYCLE ENGINE

(75) Inventor: Masahiko Kato, Shizuoka (JP)

(73) Assignee: Yamaha Marine Kabushiki Kaisha, Shizuoka (JP)

( * ) Notice: Subject to any disclaimer, the term of this patent is extended or adjusted under 35 U.S.C. 154(b) by 0 days.

(21) Appl. No.: 10/253,958

(22) Filed: Sep. 24, 2002

(65) Prior Publication Data

US 2003/0062006 A1 Apr. 3, 2003

(30) Foreign Application Priority Data

Sep. 28, 2001 (JP) ..... 2001-301583

(51) Int. Cl.[7] ..... F02B 33/04
(52) U.S. Cl. ..... 123/73 AD
(58) Field of Search ..... 123/73 AD, 196 R, 123/196 W, 196 CP, 196 S

(56) References Cited

U.S. PATENT DOCUMENTS 4,414,929 A 11/1983 Sakurai
4,967,700 A * 11/1990 Torigai ..... 123/73 AD
5,020,484 A 6/1991 Ishikawa et al.
5,195,481 A 3/1993 Oyama et al.
5,375,573 A 12/1994 Bowman
5,501,190 A 3/1996 Okubo et al.
5,513,608 A 5/1996 Takashima et al.
5,537,959 A 7/1996 Ito
5,778,836 A * 7/1998 Sougawa et al. ..... 123/65 P
6,216,651 B1 4/2001 Ishikawa et al.
6,318,331 B1 11/2001 Hiraoka et al.
6,374,781 B1 4/2002 Kato
6,422,183 B1 7/2002 Kato
6,443,109 B1 9/2002 Achor et al.
6,516,756 B1 * 2/2003 Kato et al. ..... 123/73 AD

FOREIGN PATENT DOCUMENTS

JP 04031658 A * 2/1992 ..... F02M/9/10

* cited by examiner

*Primary Examiner*—Tony M. Argenbright
*Assistant Examiner*—Hyder Ali
(74) *Attorney, Agent, or Firm*—Knobbe, Martens, Olson & Bear, LLP

(57) ABSTRACT

A lubrication system for a two-cycle engine includes an oil delivery system for delivering oil to an air intake passageway of the engine. Oil is mixed with the intake air in the intake passageway and is then carried by the intake air into the crankcase chamber and combustion chamber, thereby lubricating the components therein. The oil delivery system includes an oil discharge pipe in communication with the intake passageway and is generally located adjacent an upper surface of the intake passageway.

11 Claims, 9 Drawing Sheets

LUBRICATION SYSTEM FOR TWO-CYCLE ENGINE

PRIORITY INFORMATION

This application is based on and claims priority to Japanese Patent Application No. 2001-301583, filed Sep. 28, 2001, the entire contents of which is hereby expressly incorporated by reference.

BACKGROUND OF THE INVENTION

1. Field of the Invention

The present invention relates to oil injection lubrication for engines and more particularly to oil injection systems and methods for lubricating a two-cycle engine.

2. Description of the Related Art

In two-cycle engines, it is a common practice to mix lubricating oil with induction air to lubricate engine parts. Typically, the intake air is pre-compressed inside a crank chamber before being sent into the cylinders. In this type of two-cycle engine, oil is guided to an intake passage and further into the engine by the intake air. More specifically, the oil encounters the intake air inside the intake passage and is misted therein. The misted oil is then drawn into the crank chamber as the piston ascends and a valve opens to allow intake air to enter the crank chamber. The misted oil lubricates rotating parts in and around the crankshaft and within the interior wall of the cylinder.

In conventional two-cycle engines, fuel mixes with the intake air inside the intake passageway to reduce the viscosity of the oil which promotes misting of the oil. However, in direct injection-type two-cycle engines in which the fuel is directly sprayed into the combustion chamber, the viscosity of the oil drawn into the crank chamber is not reduced by dilution with the fuel. The undiluted liquid oil is, therefore, more difficult to convert into a mist. Since the oil may not be sufficiently misted in the intake air, the amount of oil supplied to the engine may be reduced. Insufficiently misted oil results in liquid oil depositing onto the interior surfaces inside the intake passageway. More liquid oil deposits on the surfaces within the intake passageway when the flow of intake air decreases, such as during low speed operation. Consequently, as engine speed increases, the increased speed of the intake air carries oil that has accumulated within the intake passageway in addition to oil newly discharged from the oil discharge pipes, which results in excess oil burning within the combustion chamber, evidenced by white smoke emanating from the engine.

SUMMARY OF THE INVENTION

One aspect of the present invention includes the realization that by increasing the amount of time oil leaving the discharge pipe free-falls in the intake passageway, causes the oil to be more reliably misted into the crankcase. For example, by increasing the free-fall time of oil discharged into the intake passage, the oil is exposed to a greater volume of intake flowing therethrough. Thus, for example, but without limitation, by locating an oil discharge pipe close to the upper surface of the intake passageway, liquid oil being discharged therefrom will have a maximum fall time before it contacts the lower surface of the intake passageway, during which time, a greater volume of intake air will have an opportunity to flow through the intake passageway and thereby break down the oil into a mist and carry the misted oil into the crankcase chamber.

According to another aspect, a lubrication system for a two-cycle engine comprises an oil discharge pipe positioned on the upstream side of a reed valve within an intake passageway and is in the vicinity of an upper surface of the intake passageway. The oil discharge pipe has an oil discharge opening therein which is spaced below the upper surface of the intake passageway and is generally above the reed valve.

According to yet another aspect, a two-stroke internal combustion engine has one or more cylinders with each cylinder having a piston for reciprocation therein. A connecting rod is rotatably coupled to each piston and is further connected to a throw of a crankshaft. The crankshaft is disposed generally vertically within a crankcase chamber. An air induction system has an intake passageway defined by an upper wall, a lower wall, and side walls, that is in communication with the crankcase chamber through one or more valves. An oil discharge pipe is disposed within the intake passageway in close proximity to the intake passage upper wall.

According to a further aspect, an outboard motor has a powerhead, a driveshaft housing depending from the powerhead, and a lower unit connected to and disposed below the driveshaft housing. The powerhead includes an internal combustion engine coupled to a propeller of the lower unit through a driveshaft extending through the driveshaft housing for propelling a watercraft. The internal combustion engine comprises a cylinder block defining a cylinder bore. A cylinder head has a recess in a lower surface thereof and is connected to the cylinder block, which combine with a surface of a piston to define a combustion chamber. A crankshaft is disposed generally vertically within a crankcase chamber defined, in part, by a crankcase member. The crankshaft is configured for rotation and is coupled to the piston by a connecting rod having a large end connected to a throw of the crankshaft and a small end connected to the piston.

The crankcase member defines an air intake passageway that has a valve therein for regulating the delivery of air and oil to the crankcase chamber. The intake passageway has an oil discharge pipe positioned therein at a location that is near an upper wall of the intake passageway and spaced away from a sidewall of the intake passageway. The oil discharge pipe is configured to provide oil within the intake passageway to allow the intake air to blow the oil past the valve and into the crankcase chamber.

According to another aspect, a lubrication system for a two-cycle engine includes an oil discharge pipe positioned on the upstream side of a reed valve within an intake passageway and in the vicinity of an upper surface of the intake passageway. The system further includes an oil discharge opening in the oil discharge pipe spaced below the upper surface of the intake passageway. The oil discharge opening may be positioned generally above the reed valve. Furthermore, the oil discharge opening may be positioned near a sidewall of the intake passageway and open toward an opposing sidewall of the intake passageway.

According to an additional aspect, a two-stroke direct fuel injected internal combustion engine has a crankshaft journaled for rotation within a crankcase chamber, and air intake passageway in selective communication with the crankcase chamber and is separated therefrom by a reed valve. The internal combustion engine further includes means for discharging oil into the intake passageway and means for increasing the amount of air that the oil discharged into the intake passageway is exposed to.

DETAILED DESCRIPTION OF THE PREFERRED EMBODIMENT

In the following description, reference is made to the accompanying drawings which form a part of this written description which show, by way of illustration, specific embodiments in which the invention can be practiced. It is to be understood that other embodiments may be utilized and structural changes may be made without departing from the scope of the present invention. Where possible, the same reference numbers will be used throughout the drawings to refer to the same or like components. Numerous specific details are set forth in order to provide a thorough understanding of the present invention; however, it would be obvious to one skilled in the art that the present invention may be practiced without the specific details or with certain alternative equivalent devices and methods to those described herein. In other instances, well-known methods, procedures, components and devices have not been described in detail so as not to unnecessarily obscure aspects of the present invention.

Figure 1:
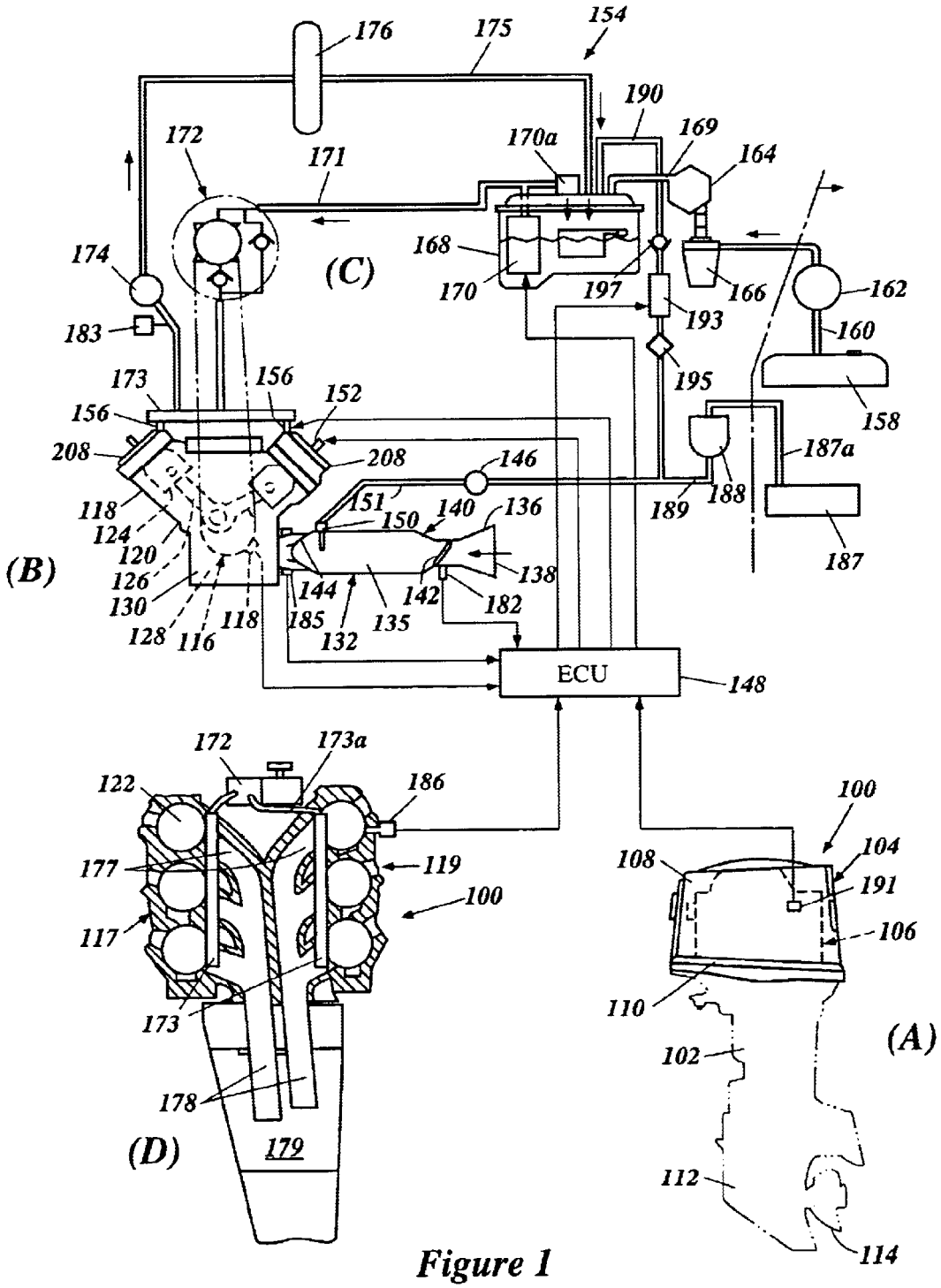
FIG. 1 is a schematic diagram illustrating the fuel and oil supply system of an engine in which one embodiment of the lubrication system of the present invention is mounted.

With reference to FIG. 1, and initially Section A, an outboard motor constructed and operated in accordance with a preferred embodiment of the invention is depicted in a side elevational view and is identified generally by the reference numeral 100. The entire outboard motor 100 is not depicted in that the swivel bracket and the clamping bracket which are associated with the driveshaft housing indicated generally by the reference numeral 102 are not illustrated. These components are well known in the art and thus the specific method by which the outboard motor 100 is mounted to the transom of an associated watercraft is not necessary to permit those skilled in the art to understand or practice the invention.

The outboard motor 100 includes a powerhead indicated generally by the reference numeral 104. The powerhead 104 is positioned above the driveshaft housing 102 and includes a powering internal combustion engine indicated generally by the reference numeral 106. The engine 106 is shown is more detail in the remaining three views of FIG. 1 and is described below with reference thereto.

The powerhead 104 is completed by a protective cowling formed by a main cowling member 108 and a lower tray 110. The main cowling member 108 is detachably connected to the lower tray 110. The lower tray 110 encircles an upper portion of the driveshaft housing 102 and a lower end of the engine 106.

Positioned beneath the driveshaft housing 102 and coupled thereto is a lower unit 112 in which a propeller 114 which forms the propulsion device for the associated watercraft is journaled. As is typical with outboard motor practice, the engine 106 is supported in the powerhead 104 so that its crankshaft 116 (see Section B of FIG. 1) rotates about a vertically extending axis. This facilitates connection of the crankshaft 116 to a driveshaft which extends into the lower unit 112 and which drives the propeller 114 through a conventional forward-neutral-reverse transmission contained in the lower unit 112.

The details of the construction of the outboard motor 100 and the components which are not illustrated may be considered to be conventional or of any type known to those wishing to utilize the invention disclosed herein. Those skilled in the art can readily refer to any known constructions of such with which to practice the invention.

With reference now in detail to the construction of the engine 106 still by primary reference to FIG. 1, the illustrated embodiment of the engine 106 is of the V6-type and operates on a two-stroke crankcase compression principal. Although the invention is described in conjunction with an engine having a particular cylinder number and cylinder configuration, it will be readily apparent that the invention can be utilized with engines having other cylinder numbers and other cylinder configurations. Also, although the engine 106 is described as operating on a two-stroke principal, it will also be apparent to those skilled in the art that certain facets of the invention can be employed in conjunction with four-stroke engines. Some features of the invention may also be employed with rotary-type engines.

With reference primarily to Sections B and D of FIG. 1, the engine 106 comprises a cylinder block 118 that is formed with a first cylinder bank 117 and a second cylinder bank 119, collectively referred to as cylinder banks 120. Each of the cylinder banks 120 comprises three vertically spaced, horizontally extending cylinder bores 122. The cylinder bores 122 are numbered #1–6 from top to bottom and will be referred to individually as cylinder 1, cylinder 2, etc. Pistons 124 reciprocate in the cylinder bores 122. The pistons 124 are in turn connected to the upper or small ends of connecting rods 126. The big ends of these connecting rods are journaled on the throws of the crankshaft 116 in a manner that is well-known in the art.

The crankshaft 116 is journaled in a suitable manner for rotation within a crankcase chamber 128 that is formed by part of the cylinder block 118 and by the crankcase member 130. The crankcase member 130 is affixed to the cylinder block 118 in a suitable manner. As is typical with two-cycle engines, the crankshaft 116, cylinder block 130, and crankcase member 130 are formed with seals so that each section of the crankcase 128 which is associated with one of the cylinder bores 122, is sealed from the other sections. This type of construction is well-known in the art.

Figure 2:
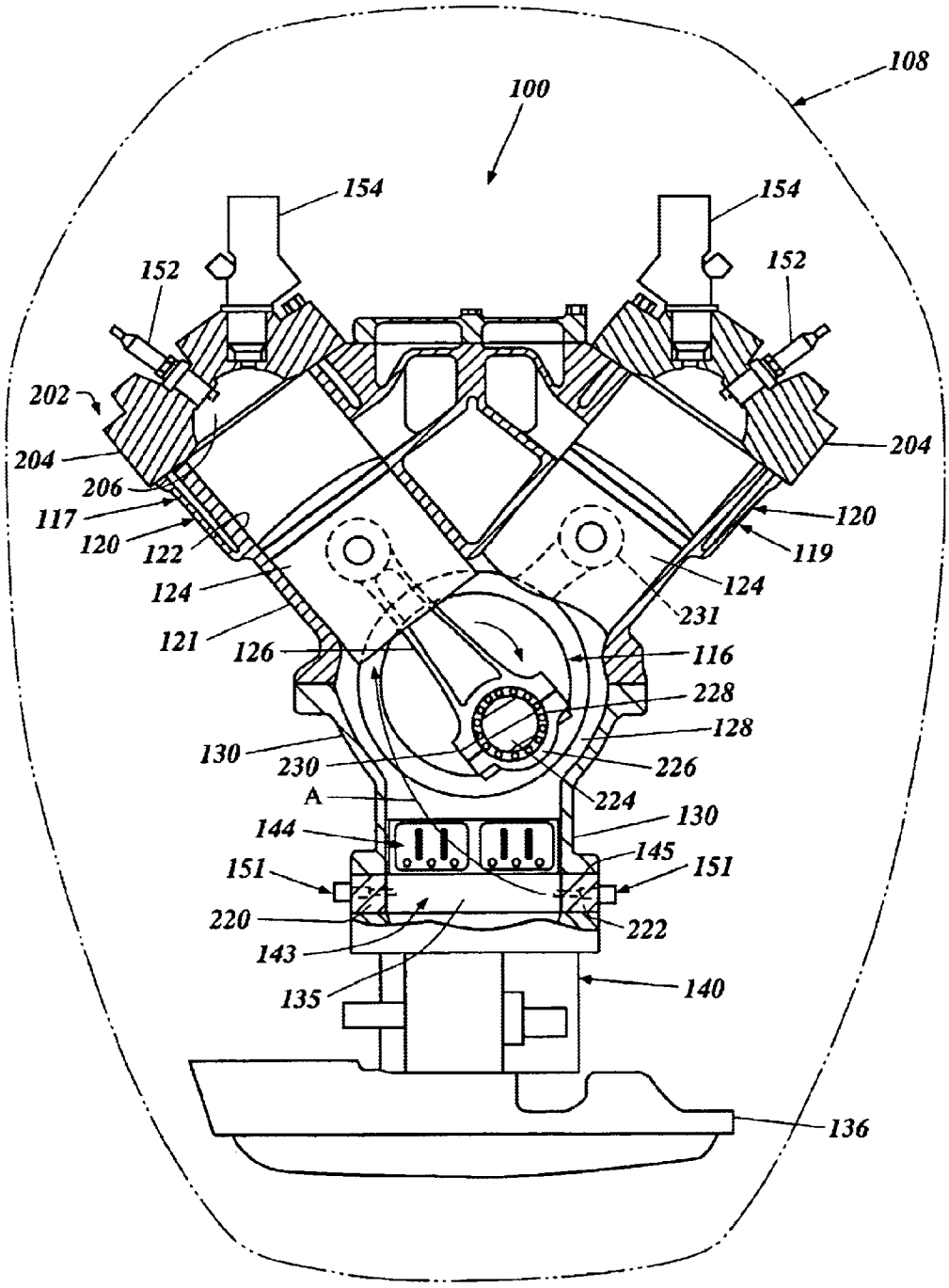
FIG. 2 is a partial top plan and a cross-sectional view of the outboard motor illustrated in FIG. 1, showing a crankshaft and piston rod assembly within a crankcase of the engine, and further showing a flow path of lubrication oil mixed with intake air.
Figure 3:
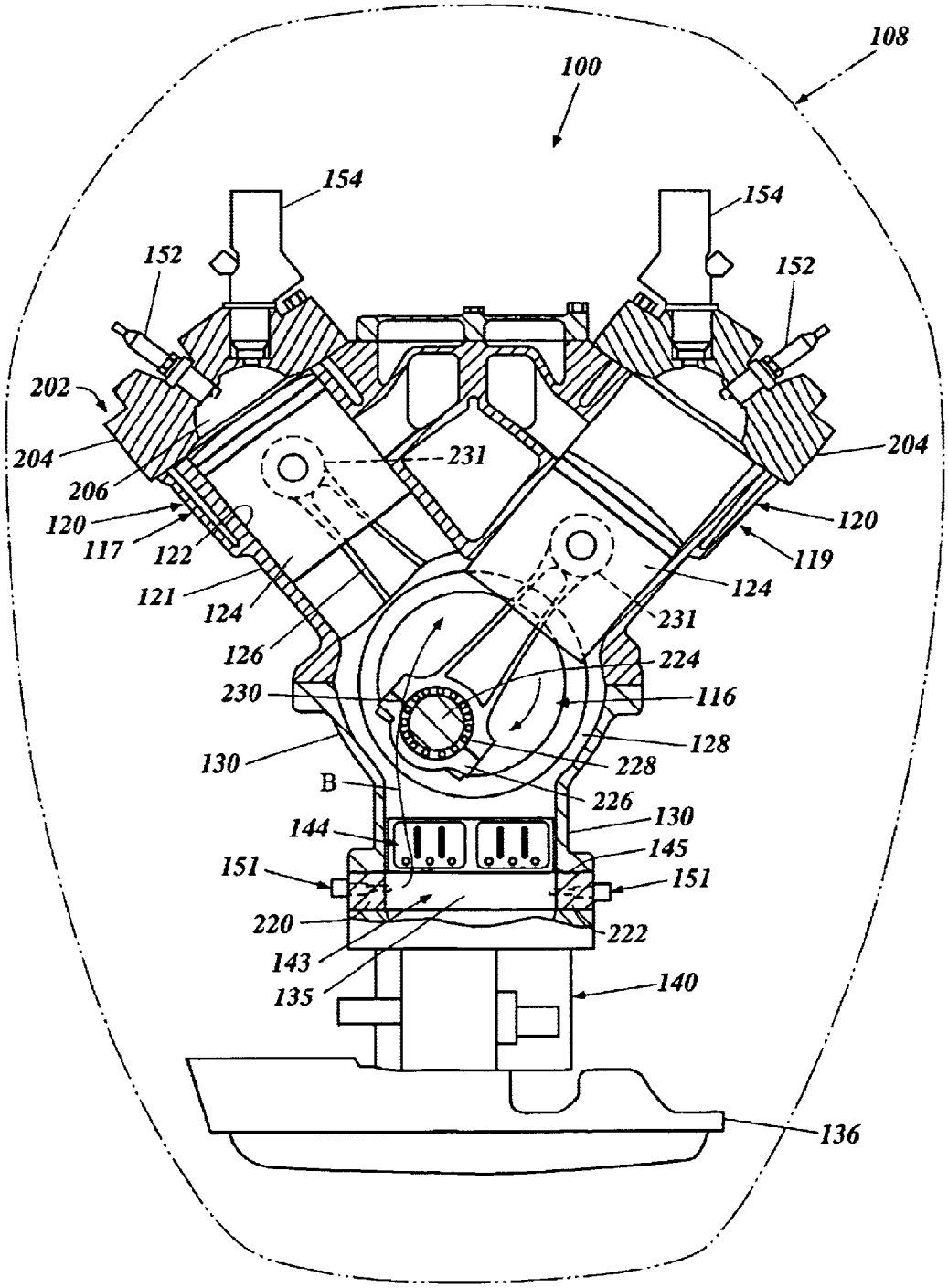
FIG. 3 is another partial top plan and a cross-sectional view of the outboard motor illustrated in FIG. 1, showing a crankshaft and piston rod assembly within a crankcase of the engine, further showing an additional flow path of lubrication oil mixed with intake air.

With additional reference to FIGS. 2 and 3, a cylinder head assembly, indicated generally by the reference numeral 202, is affixed to an end of each cylinder bank 120 that is spaced from the crankcase chamber 128. The cylinder head assemblies 202 comprise a main cylinder head member 204 that defines a plurality of recesses 206 on its inner face. Each of these recesses 206 cooperate with a respective cylinder bore 122 and the head of the piston 124 to define the combustion chambers of the engine as is well known in the art. A cylinder head cover member 208 completes the cylinder head assembly 202. The cylinder head members 204, 208 are affixed to to the respective cylinder banks 120 in a suitable known manner.

With reference again primarily to FIG. 1, Sections B and C, an air induction system indicated generally by the reference numeral 132 is configured to guide an air charge to the sections of the crankcase chamber 128 associated with each of the cylinder bores 122. This communication is via an intake port 134 formed in the crankcase member 130 and registering with each such crankcase chamber section.

The induction system 132 includes an air silencing and inlet device shown schematically in this FIG. 1 and indicated by the reference numeral 136. The device 136 is typically contained within the cowling 108 at the forward end thereof and has a rearwardly facing air inlet opening through which air is drawn, as is known in the art. Air is admitted into the interior of the cowling 108 in a known manner such as primarily through a pair of rearwardly positioned air inlets as is generally well-known in the art.

The air inlet device 136 supplies the induced air through a plurality of throttle bodies 140, each of which includes a throttle valve 142 positioned therein. The throttles valves 142 are supported for rotation on throttle valve shafts (not shown). The throttle valve shafts are linked to each other for simultaneous opening and closing of the throttle valves 142 in a manner well-known in the art.

As is also typical in two-cycle engine practice, the intake ports 134 are provided with reed-type check valves 144. The check valves 144 permit air to flow into the sections of the crankcase chamber 128 when the pistons 124 are moving toward the recesses 206 in their respective cylinder bores 122. As the pistons 124 move toward the crankcase 128, the charge is compressed in the sections of the crankcase chamber 128. At that time, the reed-type check valve 144 closes so as to permit the charge to be compressed.

In accordance with at least one preferred embodiment of the present invention, an oil pump 146 pumps oil to a solenoid valve unit 150 through an oil delivery hose 151. In one preferred embodiment, the oil pump 146 is driven by the crankshaft 116; however, an electric oil pump may be used in the alternative. The solenoid valve unit 150 can regulate the delivery of oil to the throttle body 140 of each cylinder 122, in which case, the oil passes through the throttle body 140 and into the crankcase chamber 128 to lubricate the components of each cylinder 122. The air charge, which is compressed in the sections of the crankcase chamber 128, is then transferred to the combustion chamber through a scavenging system (not shown) in a manner that is well-known.

A sparkplug 152 is mounted in the cylinder head assembly 202 for each cylinder bore. The sparkplug 152 is fired under control of an ECU 148 (electronic control unit). The ECU 148 receives certain signals for controlling the timing of firing of the sparkplugs 152 in accordance with any desired control strategy.

The sparkplug 152 ignites a fuel-air charge that is formed by mixing the intake air with fuel supplied from a fuel delivery system 154. With reference to Section C and D of FIG. 1, the fuel supply system 154 is configured to supply fuel to the combustion chambers through fuel injectors 156. In the illustrated embodiment, the fuel system 154 comprises a main fuel supply tank 158 that is provided in the hull of the watercraft with which the outboard motor 100 is associated. Fuel is drawn from this tank 158 through a conduit 160 by a first low pressure pump 162 and at least one second low pressure pump 164. The first low pressure pump 162 is a manually operated pump and the second low pressure pump 164 is a diaphragm-type pump operated by variations in pressure in the sections of the crankcase chamber 128 and thus provides a relatively low pressure. A quick disconnect coupling is provided in the conduit 160 and a fuel filter 166 is positioned in the conduit 160 in an appropriate location.

From the low pressure pump 164, fuel is supplied through a vapor separator 168 which is mounted on the engine 106 or within the cowling 108 at an appropriate location. This fuel is supplied through a line 169 and a float valve regulates fuel flow through the line 169. The float valve is operated by a float that is disposed within the vapor separator 168 so as to maintain a generally constant level of fuel in the vapor separator 168.

A high pressure electric fuel pump 170 is provided in the vapor separator 168 and pressurizes fuel that is delivered through a fuel supply line 171 to a high pressure fuel pump indicated generally by the reference numeral 172. The electric fuel pump 170 which is driven by an electric motor develops a pressure such as within the range of from about 3 to about 10 kg/cm$^2$. A low pressure regulator 170A is positioned in the line 171 at the vapor separator 168 and limits the pressure that is delivered to the high pressure fuel pump 172 by dumping the fuel back to the vapor separator 168.

With reference to Section D of FIG. 1, fuel is supplied from the high pressure fuel pump 172 to a pair of vertically extending fuel rails 173 through a flexible pipe 173A. The pressure in the high pressure pump 172 is regulated by a high pressure regulator 174 which dumps fuel back to the vapor separator 168 through a pressure relief line 175 in which a fuel heat exchanger or cooler 176 may be provided.

After the fuel-air charge has been formed in the combustion chamber by the injection of fuel from the fuel injectors 156, the charge is fired by firing sparkplugs 152. The injection timing and duration, as well as the control for the timing of firing of the sparkplugs 152 are controlled by the ECU 148. The ECU 148 thus controls the opening and closing of the solenoid valves of the fuel injectors 156 and in particular controls the selective supply of current to the solenoids of the fuel injectors 156.

As the charge burns and expands, the pistons 124 are driven toward the crankcase chamber 128 in the cylinder bores 122 until the pistons 124 reach the lower most position (i.e., bottom dead center). Through this movement, an exhaust port (not shown) is opened to communicate with an exhaust passage 177 formed in the cylinder block 118. The exhaust gases flow through the exhaust passages 177 to collector sections of respective exhaust manifolds that are formed within the cylinder block 118. These exhaust manifold collector sections communicate with exhaust passages formed in an exhaust guide plate on which the engine 106 is mounted.

A pair of exhaust pipes 178 extend the exhaust passages 177 into an expansion chamber 179 formed in the driveshaft housing 102. From this expansion chamber 179, the exhaust gases are discharged to the atmosphere through a suitable exhaust system. The length of the exhaust pipes 178 from the cylinder 122 to the head of the exhaust pipe 178 differs between some or all of the cylinders 122. As is well-known in outboard motor practice, this may include an underwater, high-speed, exhaust gas discharge and an above-water low speed exhaust gas discharge. Since these types of systems are well-known in the art, further description is not necessary to permit those skilled in the art to practice the invention.

Any type of desired controlled strategy can be employed for controlling the time and duration of fuel injection from the injectors 154 and timing of firing of the sparkplug 152. However, a general discussion of some engine conditions and other ambient conditions that can be sensed for engine control will follow. It is to be understood, however, that those skilled in the art will readily understand how various control strategies can be employed in conjunction with the components of the invention.

The control for the fuel-air ratio preferably includes a feedback control system. Thus, a combustion condition or oxygen sensor 180 is provided and determines the in-cylinder combustion conditions by sensing the residual amount of oxygen in the combustion products at about a time when the exhaust port is opened. This output signal is carried by a line to the ECU 148 as schematically illustrated in FIG. 1.

As shown in Section B of FIG. 1, a crank angle position sensor 181 measures the crank angle and transmits it to the ECU 148 as schematically indicated. Engine load as determined by throttle angle of the throttle valve 142 is sensed by a throttle position sensor 182 which outputs a throttle position or load signal to the ECU 148.

There is also provided a pressure sensor 183 communicating with the fuel line connected to the pressure regulator 174. This pressure sensor 183 outputs the high-pressure fuel signal to the ECU 148. Further, an intake air temperature sensor 185 may be provided when this sensor 185 outputs an intake air temperature signal to the ECU 148. Finally, a cooling water temperature sensor 191 may be provided for sensing the temperature of the engine cooling water.

The sense conditions are merely some of those conditions which may be sensed for engine control and it is, of course, practicable to provide other sensors such as, for example, but without limitation, an engine height sensor, a knock sensor, a neutral sensor, a watercraft pitch sensor and an atmospheric temperature sensor in accordance with various control strategies.

The ECU 148 computes and processes the detection signals of each sensor based on a control strategy. The ECU 148 forwards control signals to the fuel injector 156, sparkplug 152, the electromagnetic solenoid valve unit 150 and the high-pressure electric fuel pump 170 for their respective control. These control signals are carried by respective control lines that are indicated schematically in FIG. 1.

With reference to Section C of FIG. 1, an oil subtank 187 located in the hull of the watercraft serves as a reservoir of lubrication oil for the engine 106. A suitable delivery pump supplies oil from the oil subtank 187 through the oil supply pipe 187A to a main oil tank 188 mounted to the side of the cylinder block 118. The delivery pump can, for example, be located within the oil subtank 187 or can be positioned within the supply pipe 187A and can be either electrically or mechanically driven. An oil feedpipe 189 supplies oil from the bottom of the main oil tank 188 to the oil pump 146. The oil pump 146 in turn supplies oil to the solenoid valve unit 150 which regulates the flow of oil to the cylinders. The solenoid valve unit 150 is preferably controlled via control signals from the ECU 148.

In one preferred embodiment, oil is also delivered directly to the vapor separator chamber 168. A premixing oil pump 193 draws oil from the oil feedpipe 189 and through a premixing oil filter 195. The oil also passes through a reed-type check valve 197 and is then delivered to the vapor separator chamber 168 through oil conduit 190. The addition of a small amount of oil to the fuel of a fuel-injected engine has been found to inhibit the formation of deposits on fuel injectors 154 and to extend their useful life. The addition of oil may also help prevent corrosion when water is present in the system. The oil delivered directly to the combustion chamber with the fuel charge can also help to lubricate the components of the fuel system.

In at least one embodiment, a plurality of oil delivery pipes 151 are provided for delivering oil to a plurality of solenoid valve units 150 which correspond to the number of cylinders 122 in the engine 106. The oil delivery pipes 151 are preferably configured so that their lengths are as short as possible to minimize the distance the oil must travel to the air induction system 132 for each cylinder 122.

In one preferred embodiment, the oil pump 146 is a positive displacement-type oil pump that is driven by the crankshaft 116. A positive displacement type oil pump delivers a volume of oil for each crankshaft revolution as opposed to, for example, an impeller-type pump that supplies an approximate pressure of oil based upon engine speed.

Figure 7:
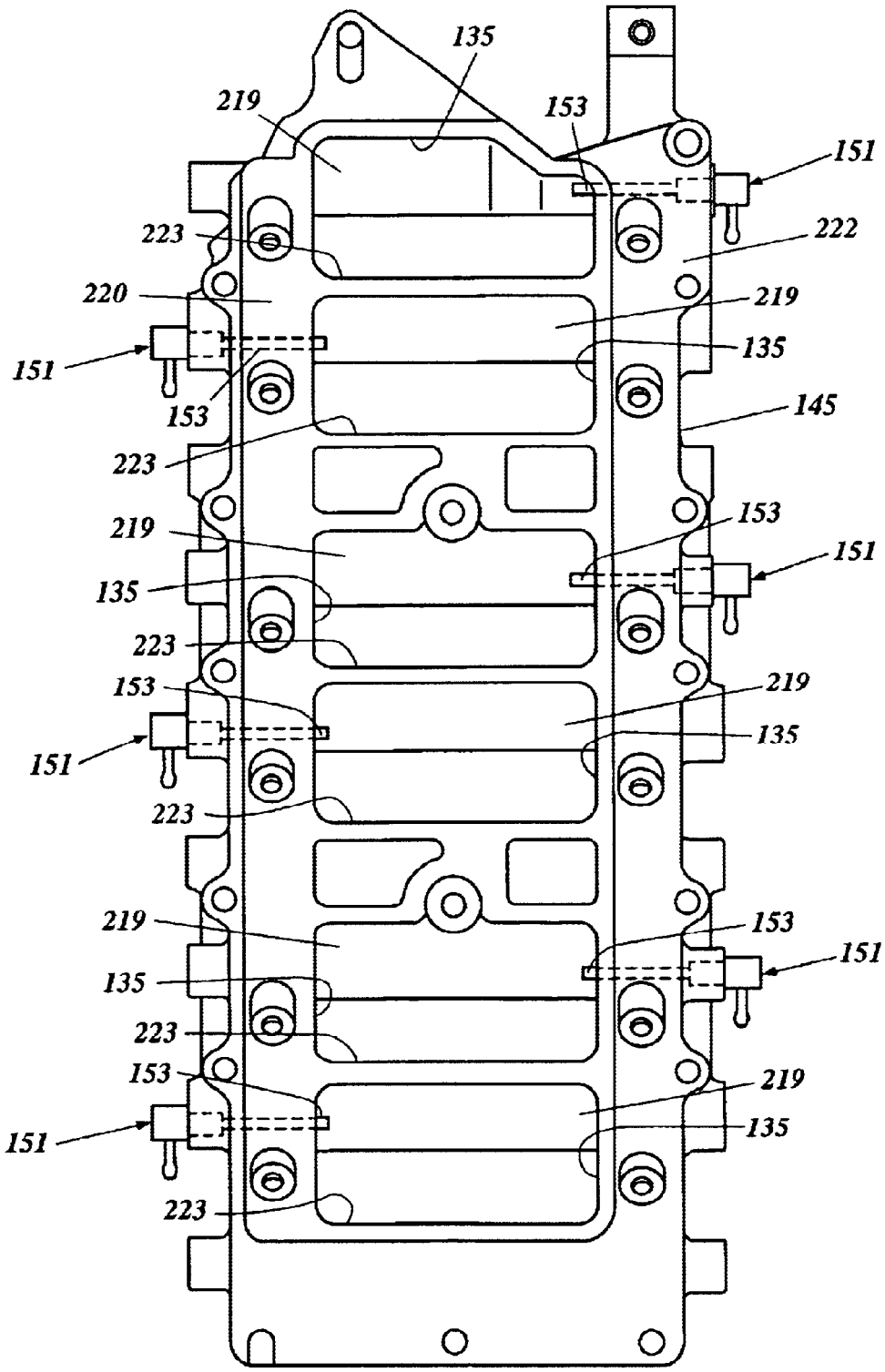
FIG. 7 is a front elevational view of an intake manifold of the engine shown FIGS. 2–5 showing the oil delivery and discharge pipes.

The oil delivered through the oil delivery pipe 151 is regulated by the solenoid valve unit 150 for delivery into the air intake passage 135 through the oil discharge pipe 153 (of FIG. 7). Preferably, the oil is sprayed into the air intake passage 135 as a mist, such that the oil is carried by the intake air passing through the air intake passage 135. The air thus carries misted oil into the crankcase chamber 128 and subsequently into the combustion chamber 206.

Figure 4:
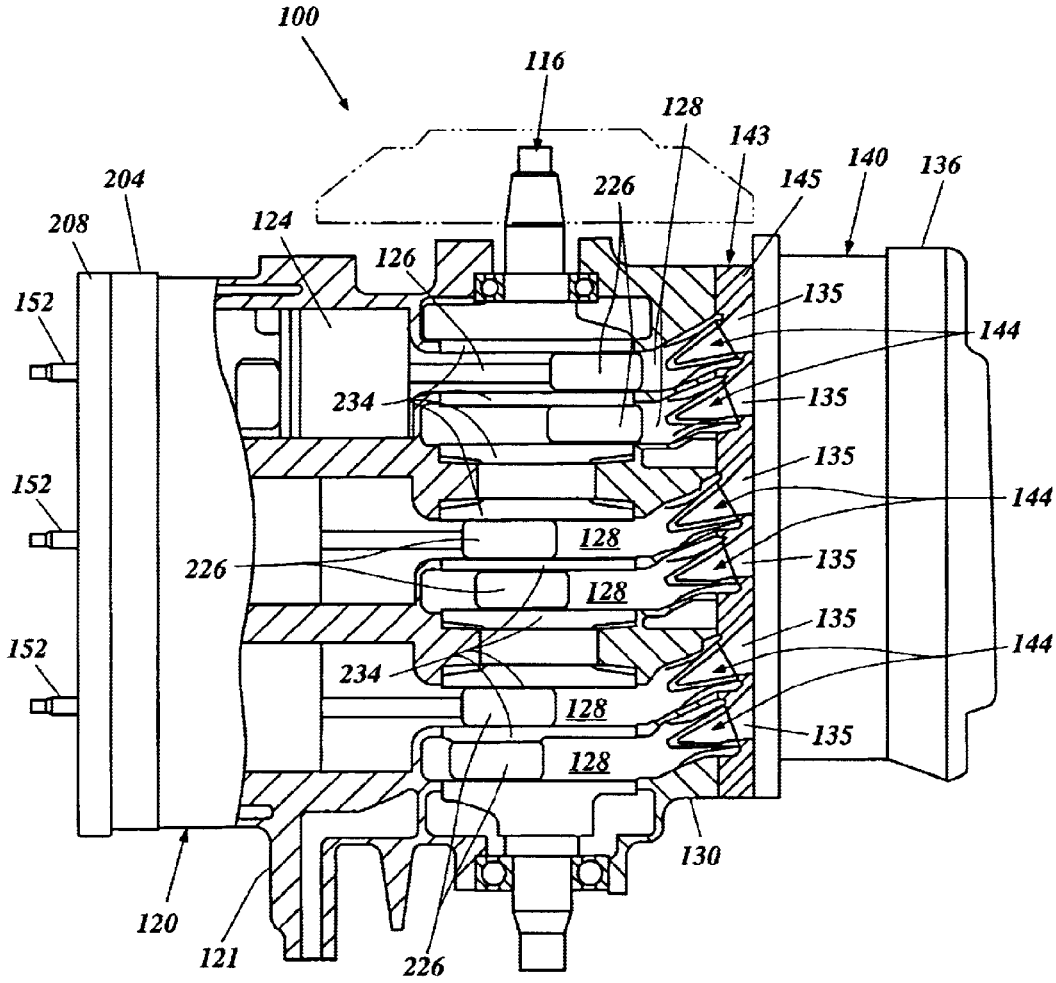
FIG. 4 is a partial sectional and starboard side elevational view of the engine showing the crankshaft, piston rod assembly, reed valves, and reed valve holders mounted to the crankcase of the engine.

With reference to FIGS. 2–4, the intake silencer 136 includes an opening for allowing intake air to enter therein. The air flows through the intake silencer 136 and is regulated by throttle valves 142 within the throttle body 140. The air intake passageway 135 is partially defined by a left side part 220 and a right side part 222 that each may hold one or more oil delivery pipes 151. The oil delivery pipes 151, in combination with the solenoid valve units 150, and oil discharge pipes 153, regulate the delivery of oil into the intake air as previously described.

A reed-valve unit 143 defines at least a portion of an intake manifold of the engine 106 and comprises a reed valve holder 145 which carries a number of reed valves 144, which typically correspond in number to the number of engine cylinders. The intake air is drawn through the reed valves 144 and into the crankcase chamber 128 as the piston 124 moves upwardly thereby causing a negative pressure within the crankcase chamber 128.

The crankshaft 116 is journaled for rotation within the crankcase chamber 118 and has a number of throws each of which are connected to a connecting rod 126. The connecting rod 126 typically terminates in a semi-circular concave inner peripheral surface 230 that corresponds to a portion of a crankshaft pin 224 of the throw. An endcap 226 cooperates with the connecting rod 126 to circumscribe the crankshaft pin 224.

A plurality of roller bearings 228 are interposed between the interior peripheral surface 230 of the connecting rod 126 and the crankshaft 116. Alternatively, the connecting rod 126 may engage the crankshaft pin 224 through other means, as are known in the art. The connecting rod 126 opposing end, or small end 231, is rotatably connected to a piston 124 as previously described.

With reference to FIG. 4, the crankshaft 116 includes a plurality of webs 234 that cooperate with the cylinder block 121 and crankcase member 130 to separate and substantially seal each crankshaft throw and associated connecting rod 126 within individual portions of the crankcase chamber 128. The air induction system delivers intake air to each of these individual portions of the crankcase chamber 128.

Figure 5:
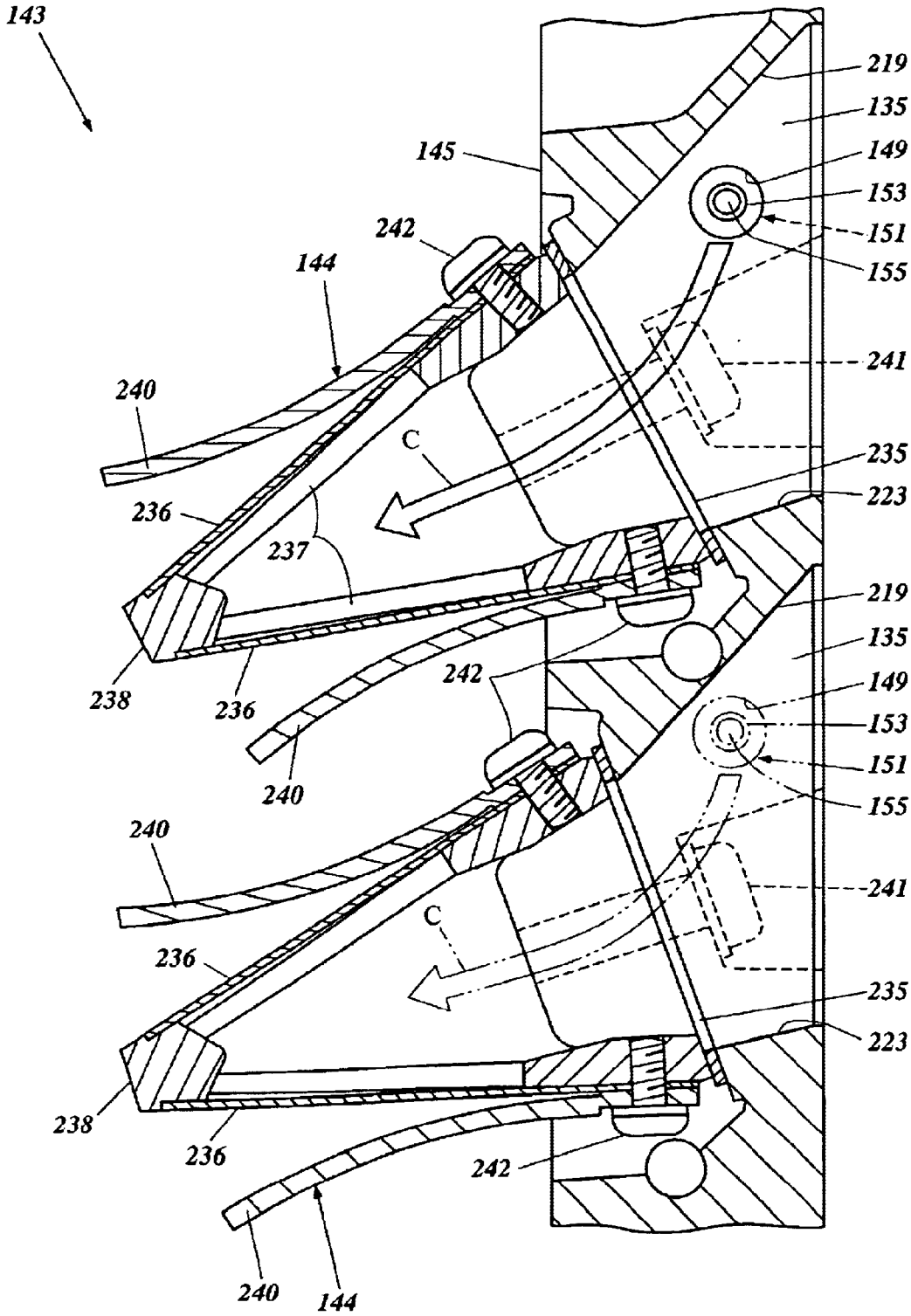
FIG. 5 is an enlarged cross-sectional view of the engine shown in FIG. 4 and schematically showing a flow of air and oil through two reed valves.

As shown in FIGS. 4 and 5, the reed valve unit 143 comprises a reed valve 144 having a reed valve holder 145 configured to carry one or more petals 236. The petals 236 are biased in a closed position against a frame 238 that is substantially triangular in shape from a side view. In this orientation, the crankcase chamber 128 is closed such that air within the crankcase chamber 128 can be compressed.

As the piston 124 moves away from the crankshaft 116 toward its uppermost limit (i.e., top dead center), the volume within the crankcase chamber 128 increases, thereby creating a negative pressure and drawing air into the crankcase chamber 128 from the intake passageway 135. This air pressure causes the petals 236 to open away from the frame 238 to thereby allow air to enter the crankcase chamber 128. The reed 236 travel limit is defined by a stopper plate 240 attached to the reed-valve holder 145, such as by mounting screws 242. In this particular embodiment, a pair of petals 236 are each coupled to oblique sides of the frame 238 and cooperate to open and close the reed valve 144.

Figure 6A:
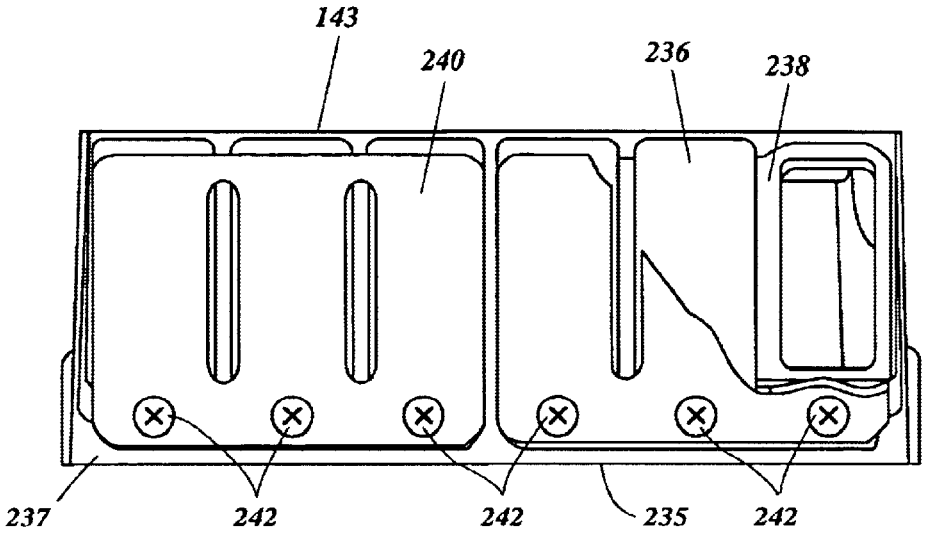
FIG. 6*a* is a partial cutaway plan view of a reed valve holder and reed values removed from the engine shown in FIG. 4.
Figure 6B:
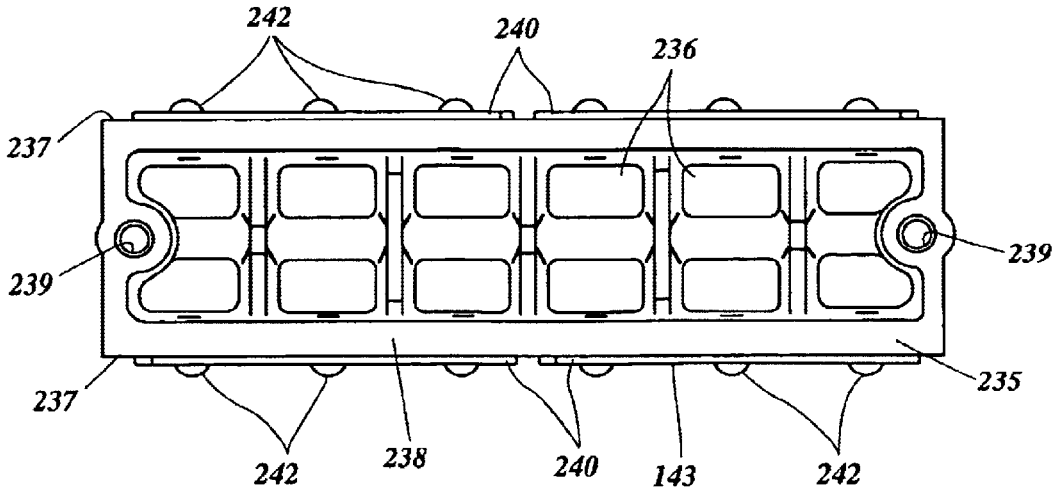
FIG. 6*b* is an elevational view of the upstream end of the reed valve holder and reed valves removed from the engine shown in FIG. 6*a*.

With additional reference to FIGS. 6*a* and 6*b*, alternate views of the reed valve unit 143 are provided. The frame 238 is substantially triangular when viewed from the side, and as such, includes a mounting surface 235, and two oblique surfaces 237. The mounting surface 235 includes mounting holes 239 for mounting the reed valve unit to the end of the intake passageway, such as by screws 241. Each oblique surface 237 has a reed 236 mounted thereto, such as by a mounting screw 242, such that, when the reed 236 overlaps the oblique surface 237, the reed valve 144 is closed. The mounting screw 242 may also secure the stopper plate 240 to the oblique sides 237 of the frame 238.

As shown in FIG. 6*b*, the mounting surface 235 resembles a peripheral frame and is generally open through its interior portion to allow communication between the reed valves 144 and the intake passageway 135 to which the reed valve unit 143 is attached. As the pistons 124 reciprocate, the resulting volumetric change within the crankcase chamber 128 creates a reduced pressure within the crankcase chamber 128. Consequently, there is a pressure differential on either side of the reed valves 144 that causes the petals 236 to move away from the frame 238, thereby allowing intake air to pass through the reed valves 144 and into the crankcase chamber 128 beyond.

Turning to FIG. 7, intake passageways 135 are in communication with associated reed valve units 144 (not shown). Each intake passageway 135 is defined, in part, by an upper surface 219, a left side part 220, a right side part 222, and a lower surface 223. An oil delivery pipe 151 provides oil to each intake passage way, and terminates in an oil discharge pipe 153 that extends into each intake passageway.

Figure 8:
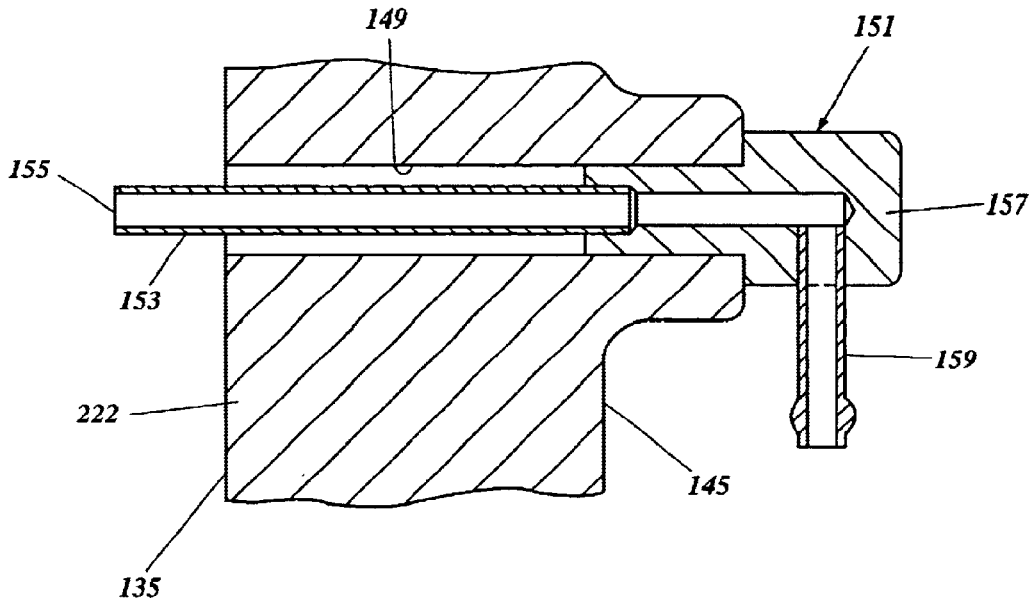
FIG. 8 is a partial cross sectional view of the oil delivery and discharge pipes of FIG. 7.

More specifically, with reference to FIG. 8, the right side part 222 and left side part 220 (of FIG. 7) comprise a reed valve holder 145 that has one or more through holes 149 formed therein. A socket 157 has an oil discharge pipe 153 connected thereto, and is configured to fit within the through hole 149 formed in the reed valve holder 145. The socket 157 is further coupled to a joint pipe 159 that is connected to an outlet end of an oil pump by an oil delivery pipe 151. As used herein, the term oil delivery pipe may be used generally to describe the oil supply system including the components that make up the oil flow path from the oil reservoir to the oil discharge pipe 153. Each oil discharge pipe 153 has an oil outlet port 155 in communication with the intake passageway 135.

Preferably, the oil outlet port 155 is disposed away from the walls of the intake passageway 135 so that oil discharged therefrom will not immediately adhere to the walls of the intake passageway 135. More preferably, the oil discharge port 155 is spaced in close proximity to the upper surface 219 of the intake passageway 135 as described below in further detail.

Returning to FIGS. 5 and 7, the oil discharge pipes 153 are disposed within the air intake passageway 135 at a location that is in the general vicinity of the upper surface 219 of the intake passageway 135. Furthermore, the discharge pipes 153 are preferably disposed generally above the reed valve holder 145, such that liquid oil that falls down into the intake passageway 135 will preferably fall on the reed valves 144 rather than in the intake passageway 135.

During engine operation, oil is discharged from the discharge pipe 153 into the intake passageway 135 from each oil delivery pipe 151 disposed in the reed valve holder 145. As shown by arrow C of FIG. 5, the discharged oil will be forced downstream and carried by the intake air flowing within the intake passageway 135. To reduce the effects of liquid oil depositing within the intake passageway suffered by prior art engines, the oil discharge pipes 153 are disposed in the vicinity of the upper surface 219 of the intake passageway 135, thereby increasing the distance between the outlet port 155 and the lower surface 223 of the intake passageway 135. By increasing the distance between the oil discharge pipes 153 and the lower surface of the intake passageway 135, the liquid oil can bree-fall longer and thus has more opportunity to be carried away by the intake air into the crankcase chamber 128, even during periods of low speed engine operation.

Returning to FIGS. 2 and 3, the oil supply pipes 151 disposed in the right side part 222 provide oil to the cylinders in the first cylinder bank 117, as illustrated in FIG. 2 by arrow A, while the oil supply pipes 151 disposed in the left side part 220 provide oil to the cylinders in the second cylinder bank 119, as illustrated in FIG. 3 by arrow B. The timing of the oil delivery may be coordinated by the ECU to correspond with the appropriate piston stroke. As described above, the air and oil mixture is drawn into the crankcase chamber 128 during the upstroke (i.e. as the piston moves toward top dead center), and then forced into the combustion chamber 206 during the downstroke (i.e., as the piston moves toward bottom dead center) through scavenging passages (not shown) as is well-known in the art.

As the intake air circulates throughout the crankcase chamber 128, some of the oil is deposited onto the components disposed within the crankcase chamber 128, such as the roller bearings 228 between the connecting rod 126 and crankshaft throw 224, for example, thereby providing necessary lubrication.

Because the air and oil mixture flows in the direction of travel of the crankshaft, which in this embodiment, is clockwise, the air and oil mixture is directed along relatively equidistant flow paths thereby providing a substantially equal amount of air and oil mixture to each cylinder bank 120.

Figure 9:
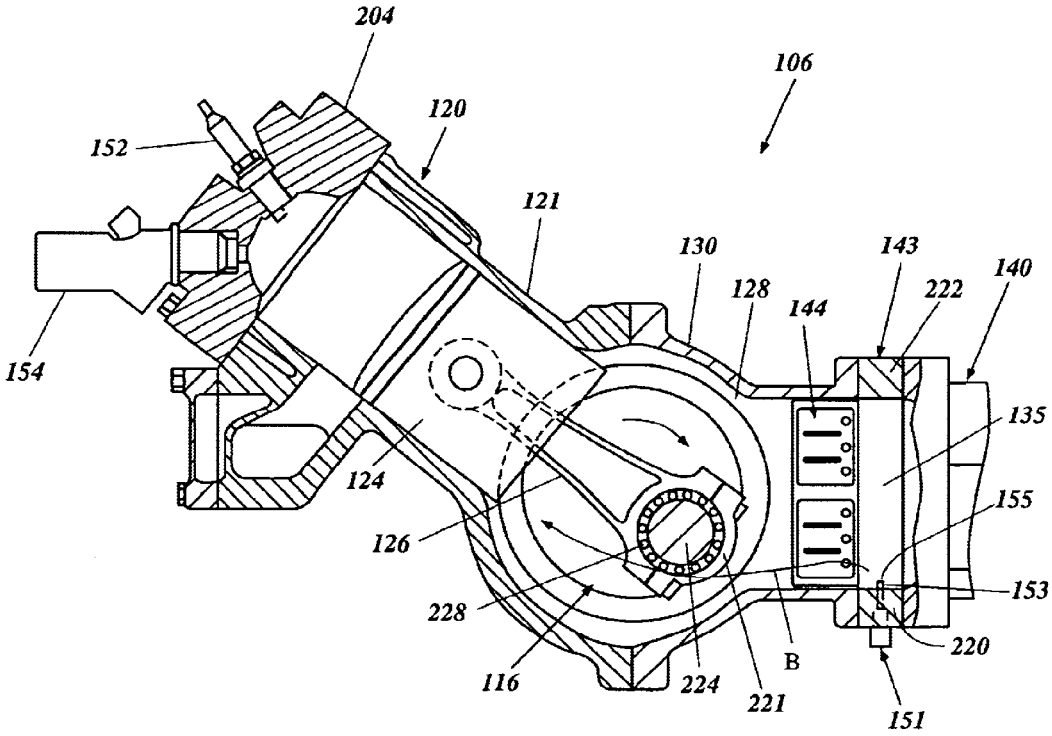
FIG. 9 is a partial sectional and top plean view of a modification of the engine shown in FIGS. 1–8 and illustrating a flow path of lubrication oil mixed with intake air therethrough.

While one embodiment herein illustrates a lubrication system used in an internal combustion engine having cylinders in a V-type arrangement, FIG. 9 illustrates an embodiment of the lubrication system utilized in an internal combustion engine in which the cylinders are arranged in-line.

An internal combustion engine 106 is constructed according to the foregoing description. Similar, or equivalent, elements described in FIGS. 1–8 are designated with like numerals and their detailed description is omitted as unnecessary in light of the foregoing description. In an engine having this in-line cylinder configuration, the oil discharge pipes 153 can be provided only on one side of the intake passageway 135, which in this illustration, is the left side part 220. The discharge pipes 153 are thus disposed on a forward side (the clockwise direction) of the rotational direction of the crankshaft 116. Consequently, the crankshaft pin 224 and attached connecting rod 126 pass within close proximity to the oil discharge pipes 153 and thereby receive a sufficient amount of lubricating oil to lubricate the bearings 228 disposed between the crankshaft pin 224 and the connecting rod 126.

Locating the oil discharge pipes 153 on this side of the intake passageway provides the added benefit of reducing the travel distance of the air and oil mixture as it flows to the cylinder. As described with respect to other embodiments herein, the discharge pipes 153 are preferably disposed within close proximity to the upper surfaces of the intake passageways 135, thereby increasing the distance between the outlet port 155 and the lower surface of the intake passageway 135. Preferably, the outlet port 155 is positioned to maximize the distance between the outlet port 155 and the lower surface of the intake passageway 135. Therefore, the liquid oil discharged from the outlet port 155 will encounter an increased volume of flowing air to blow the oil through the reed valves 144 and into the crankcase chamber 128.

Alternatively, the oil discharge pipes can be disposed within the intake passageway 135 at a location that is downstream from the reed valves 144, thereby more efficiently supplying oil to the crankcase chamber 128 and inner components.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. In addition, while a number of variations of the invention have been shown and described in detail, other modifications, which are within the scope of this invention, will be readily apparent to those of skill in the art based upon this disclosure. It is also contemplated that various combinations or subcombinations of the specific features and aspects of the embodiments may be made and still fall within the scope of the invention. Accordingly, it should be understood that various features and aspects of the disclosed embodiments can be combined with or substituted for one another in order to form varying modes of the disclosed invention. Thus, it is intended that the scope of the present invention herein disclosed should not be limited by the particular disclosed embodiments described above, but should be determined only by a fair reading of the claims that follow.

What is claimed is:

1. A lubrication system for a two-cycle engine comprising an oil discharge pipe positioned on the upstream side of a reed valve within an intake passageway and in the vicinity of an upper surface of the intake passageway, the oil discharge pipe having an oil discharge opening spaced below the upper surface of the intake passageway and generally above the reed valve, wherein the engine has a first cylinder bank and a second cylinder bank arranged in a V-type configuration, the intake passageway being defined at least in part by an intake manifold having left and right sidewalls wherein oil discharge pipes are located in both the left and right sidewalls, and wherein the oil discharge pipes in the left sidewall deliver oil to one of the cylinder banks, and the oil discharge pipes in the right sidewall deliver oil to the other cylinder bank.

2. The lubrication system of claim 1, wherein the oil discharge pipes in the left sidewall deliver oil to the first cylinder bank.

3. The lubrication system of claim 1, wherein the oil discharge pipes in the left sidewall deliver oil to the second cylinder bank.

4. A lubrication system for a two-cycle engine comprising an oil discharge pipe positioned on an upstream side of a reed valve within an intake passageway and in the vicinity of an upper surface of the intake passageway and an oil discharge opening in the oil discharge pipe spaced below the upper surface of the intake passageway, wherein the oil discharge opening is positioned near a sidewall of the intake passageway and opens toward an opposing sidewall of the intake passageway.

5. The lubrication system for a two-cycle engine of claim 4, wherein the oil discharge opening is positioned generally above the reed valve.

6. A lubrication system for a two-cycle engine comprising an oil discharge pipe positioned on an upstream side of a reed valve within an intake passageway and in the vicinity of an upper surface of the intake passageway and an oil discharge opening in the oil discharge pipe spaced below the upper surface of the intake passageway, wherein the engine comprises a first cylinder bank and a second cylinder bank arranged in a V-configuration, and a plurality of oil discharge pipes located in each of a left sidewall and a right sidewall of the intake passageway, and wherein the oil discharge pipes located in the left sidewall provide oil to the first cylinder bank and the oil discharge pipes located in the right sidewall provide oil the second cylinder bank.

7. The lubrication system for a two-cycle engine of claim 6, wherein the first cylinder bank is on the right side of the engine.

8. The lubrication system for a two-cycle engine of claim 6, wherein the second cylinder bank is on the left side of the engine.

9. A two-stroke direct fuel injected internal combustion engine having a crankshaft journaled for rotation within a crankcase chamber, an air intake passageway in selective communication with the crankcase chamber and separated therefrom by a reed valve, the internal combustion engine comprising means for discharging oil into the intake passageway, means for increasing the amount of air that the oil discharged into the intake passageway is exposed to, and means for causing the flow path of air and oil from the intake passageway and into a pair of spaced apart cylinder banks to be generally equidistant.

10. The two-stroke direct fuel injected internal combustion engine of claim 9, wherein the means for discharging oil into the intake passageway comprises an oil delivery system comprising an oil pump, an oil delivery pipe, and an oil discharge pipe.

11. The two-stroke direct fuel injected internal combustion engine of claim 9, wherein the means for increasing the volume of air that is exposed to the oil discharged into the intake passageway comprises locating the oil discharge pipe near an upper wall of the intake passageway thereby maximizing the fall distance oil must fall from the oil discharge pipe before it contacts a lower surface of the intake passageway.

* * * * *

UNITED STATES PATENT AND TRADEMARK OFFICE

CERTIFICATE OF CORRECTION

PATENT NO. : 6,863,036 B2
DATED : March 8, 2005
INVENTOR(S) : Masahiko Kato

It is certified that error appears in the above-identified patent and that said Letters Patent is hereby corrected as shown below:

Column 12,
Line 52, after "oil", please insert -- to --.

Signed and Sealed this

Eleventh Day of October, 2005

JON W. DUDAS
*Director of the United States Patent and Trademark Office*